US011047188B2

(12) United States Patent
Wells et al.

(10) Patent No.: US 11,047,188 B2
(45) Date of Patent: Jun. 29, 2021

(54) POWER CARTRIDGES FOR SETTING TOOLS

(71) Applicant: G&H Diversified Manufacturing LP, Houston, TX (US)

(72) Inventors: Joe Noel Wells, Lindale, TX (US); Clarence James Harris, Jr., Sealy, TX (US); William Ashby Dean, Kenney, TX (US)

(73) Assignee: G&H Diversified Manufacturing, LP, Houston, TX (US)

( * ) Notice: Subject to any disclaimer, the term of this patent is extended or adjusted under 35 U.S.C. 154(b) by 111 days.

(21) Appl. No.: 16/299,813

(22) Filed: Mar. 12, 2019

(65) Prior Publication Data

US 2019/0277103 A1 Sep. 12, 2019

Related U.S. Application Data

(60) Provisional application No. 62/641,741, filed on Mar. 12, 2018.

(51) Int. Cl.
*E21B 23/06* (2006.01)
*E21B 33/128* (2006.01)

(52) U.S. Cl.
CPC ..... *E21B 23/065* (2013.01); *E21B 33/128* (2013.01)

(58) Field of Classification Search
CPC .. E21B 23/065; E21B 33/128; E21B 33/1204; E21B 43/117; E21B 47/09; E21B 47/13; E21B 23/08
See application file for complete search history.

(56) References Cited

U.S. PATENT DOCUMENTS 2,692,023 A * 10/1954 Conrad ..... E21B 23/065 166/63
2,732,800 A * 1/1956 Coursen ..... F42B 3/06 102/326
2,736,261 A * 2/1956 Davis ..... F42B 3/06 102/326
2009/0159285 A1* 6/2009 Goodman ..... F42C 15/42 166/297

* cited by examiner

*Primary Examiner* — Taras P Bemko
*Assistant Examiner* — Ronald R Runyan
(74) *Attorney, Agent, or Firm* — Conley Rose, P.C.

(57) ABSTRACT

A tool string disposable in a wellbore includes a plug configured to seal against an inner surface of a tubular string disposed in the wellbore, and a setting tool coupled to the plug that includes a piston slidably disposed in a setting tool housing of the setting tool and including a central passage, and a combustible assembly disposed in the passage of the piston, wherein the combustible assembly includes a housing and combustible material disposed in the combustible assembly housing, wherein, in response to a pressurization of the central passage of the piston of the setting tool, the setting tool is configured to actuate the plug to seal against the inner surface of the tubular string.

18 Claims, 6 Drawing Sheets

POWER CARTRIDGES FOR SETTING TOOLS

CROSS-REFERENCE TO RELATED APPLICATIONS

The present application claims benefit of U.S. provisional patent application No. 62/641,741 filed Mar. 12, 2018, and entitled "Power Cartridges for Setting Tools" which is incorporated herein by reference in its entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the casing string has been perforated by the perforating gun and the downhole plug has been set, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

SUMMARY OF THE DISCLOSURE

An embodiment of a tool string disposable in a wellbore comprises a plug configured to seal against an inner surface of a tubular string disposed in the wellbore, and a setting tool coupled to the plug, comprising a piston slidably disposed in a housing of the setting tool and comprising a central passage, and a combustible assembly disposed in the passage of the piston, wherein the combustible assembly comprises a housing and combustible material disposed in the housing, wherein, in response to a pressurization of the central passage of the piston of the setting tool, the setting tool is configured to actuate the plug to seal against the inner surface of the tubular string. In some embodiments, the combustible assembly housing comprises a plurality of the planar surfaces and wherein the planar surfaces are circumferentially spaced about the housing. In some embodiments, the housing of the setting tool is coupled to a housing of the plug, and the setting comprises a mandrel coupled to the piston, the mandrel of the setting tool being coupled to a mandrel of the plug, and wherein displacement of the mandrel of the setting tool results in displacement of the mandrel of the plug. In certain embodiments, the tool string further comprises a plug-shoot firing head coupled to the setting tool, and a wireline extending from the tool string to a surface of the wellbore, wherein the plug-shoot firing head comprises an ignitor ballistically coupled to the combustible assembly and is configured to ignite the combustible material of the combustible assembly in response to receiving a signal transmitted by the wireline. In certain embodiments, the combustible assembly comprises a power cartridge. In some embodiments, the combustible assembly housing comprises a rectangular cross-section having a maximum width and a minimum width that is less than the maximum width. In some embodiments, the combustible assembly housing comprises a hexagonal cross-section having a maximum width and a minimum width that is less than the maximum width. In certain embodiments, the setting tool comprises a first chamber and a second chamber are formed in the setting tool housing, wherein fluid communication between the first chamber and the second chamber is restricted when the piston is in a first position, and wherein fluid communication is permitted between the first chamber and the second chamber when the piston is in a second position. In certain embodiments, the setting tool comprises a mandrel slidably disposed in the setting tool housing and coupled to the piston, and an annular seal positioned between the mandrel and the setting tool housing, wherein the annular seal isolates the first chamber from the second chamber in the setting tool housing. In some embodiments, an opening is formed between an outer surface of the combustible assembly housing and an inner surface of the piston, and wherein the opening comprises a flowpath for providing fluid communication between a chamber formed in the combustible assembly housing and the first chamber. In some embodiments, the opening comprises an arcuate opening formed between a planar surface of the combustible assembly housing and the inner surface of the setting tool housing.

An embodiment of a setting tool for actuating a plug in a wellbore comprises a housing comprising a central passage, wherein a first chamber and a second chamber are formed in the setting tool housing, a piston slidably disposed in the setting tool housing and comprising a central passage, and a combustible assembly disposed in the passage of the piston, wherein the combustible assembly comprises a housing and combustible material disposed in the combustible assembly housing, wherein fluid communication between the first chamber and the second chamber is restricted when the piston is in a first position, and wherein fluid communication is permitted between the first chamber and the second chamber when the piston is in a second position, wherein, in response to a pressurization of the central passage of the piston, the setting tool is configured to displace the piston between the first position and the second position. In some embodiments, the setting tool further comprises a mandrel slidably disposed in the setting tool housing and coupled to the piston, and an annular seal positioned between the mandrel and the setting tool housing, wherein the annular seal isolates the first chamber from the second chamber in the setting tool housing. In some embodiments, an opening is formed between an outer surface of the combustible assembly housing and an inner surface of the piston, and wherein the opening comprises a flowpath for providing fluid communication between a chamber formed in the combustible assembly housing and the first chamber. In certain embodiments, the opening comprises an arcuate opening formed between a planar surface of the combustible assembly housing and the inner surface of the setting tool housing. In certain embodiments, an outer surface of the combustible assembly housing comprises a plurality of circumferentially spaced planar surfaces. In some embodiments, the combustible assembly housing comprises a rectangular cross-section having a maximum width and a minimum width that is less than the maximum width. In some embodiments, the combustible assembly housing comprises a hexagonal cross-section having a maximum width and a minimum width that is less than the maximum width. In certain embodiments, the combustible assembly comprises a power cartridge.

BRIEF DESCRIPTION OF THE DRAWINGS

For a detailed description of exemplary embodiments of the disclosure, reference will now be made to the accompanying drawings in which.

DETAILED DESCRIPTION

Figure 1:
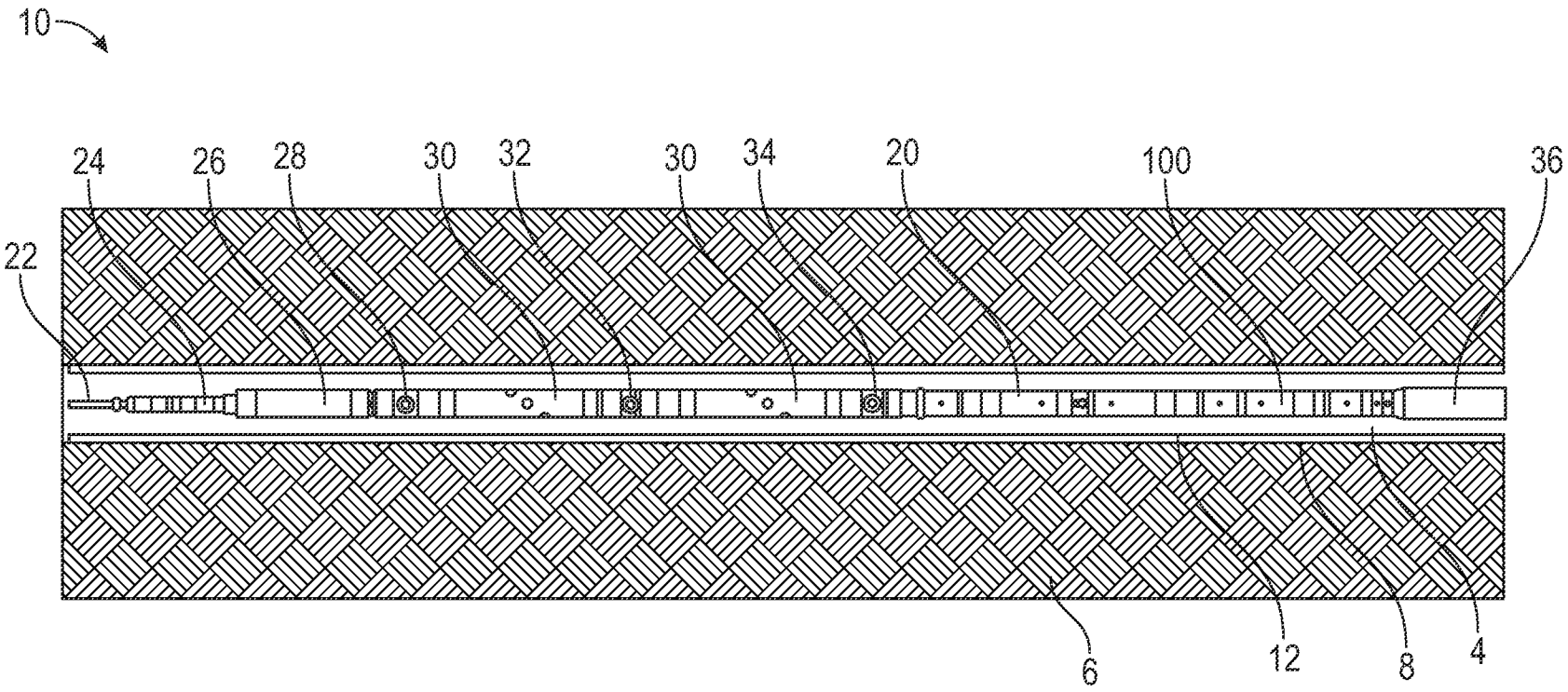
FIG. 1 is a schematic, partial cross-sectional view of a system for completing a subterranean well including an embodiment of a setting tool in accordance with the principles disclosed herein.
Figure 2:
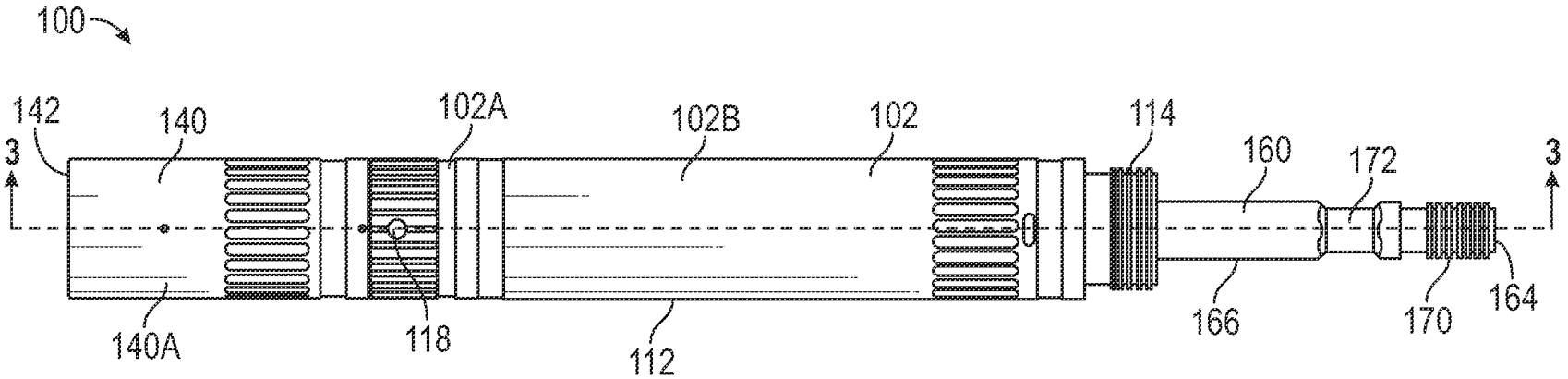
FIG. 2 is a side view of an embodiment of the setting tool of FIG. 1 in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 and may include, in some embodiments, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 30, a switch sub 32, a plug-shoot firing head 34, a setting tool 100, and a downhole or frac plug 36 (shown schematically in FIG. 1). Cable head 24 is the uppermost component of tool string 20 and includes an electrical connector for providing electrical signal and power communication between the wireline 22 and the other components (CCL 26, perforating guns 30, setting tool 100, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 30 and associated tools, such as the setting tool 100 and downhole plug 36.

Perforating guns 30 of tool string 20 are coupled to direct connect sub 28 and are generally configured to perforate casing string 12 and provide for fluid communication between formation 6 and wellbore 4. Particularly, perforating guns 30 include a plurality of shaped charges that may be detonated by a signal conveyed by the wireline 22 to produce an explosive jet directed against casing string 12.

Perforating guns 30 may be any suitable perforation gun known in the art while still complying with the principles disclosed herein. For example, in some embodiments, perforating guns 30 may comprise a hollow steel carrier (HSC) type perforating gun, a scalloped perforating gun, or a retrievable tubing gun (RTG) type perforating gun. In addition, gun 30 may comprise a wide variety of sizes such as, for example, 2¾", 3⅛", or 3⅜", wherein the above listed size designations correspond to an outer diameter of perforating guns 30.

Switch sub 32 of tool string 20 is coupled between the pair of perforating guns 30 and includes an electrical conductor and switch generally configured to allow for the passage of an electrical signal to the lowermost perforating gun 30 of tool string 20. Tool string 20 further includes plug-shoot firing head 34 coupled to a lower end of the lowermost perforating gun 30. Plug-shoot firing head 34 couples the perforating guns 30 of the tool string 20 to the setting tool 100 and downhole plug 36, and is generally configured to pass a signal from the wireline 22 to the setting tool 100 of tool string 20. Plug-shoot firing head 34 may also include mechanical and/or electrical components to fire the setting tool 100.

In this embodiment, tool string 20 further includes setting tool 100 and downhole plug 36, where setting tool 100 is coupled to a lower end of plug-shoot firing head 34 and is generally configured to set or install downhole plug 36 within casing string 12 to isolate desired segments of the wellbore 4, as will be discussed further herein. Once downhole plug 36 has been set by setting tool 100, an outer surface of downhole plug 36 seals against an inner surface of casing string 12 to restrict fluid communication through wellbore 4 across downhole plug 36. Downhole plug 36 of tool string 20 may be any suitable downhole or frac plug known in the art while still complying with the principles disclosed herein. Additionally, although setting tool 100 is shown in FIG. 1 as incorporated in tool string 20, setting tool 100 may be used in other tool strings comprising components differing from the components comprising tool string 20.

Referring to FIGS. 1-5, an embodiment of the setting tool 100 of the tool string 20 of FIG. 1 is shown in FIGS. 2-5. In the embodiment of FIGS. 2-5, setting tool 100 has a central or longitudinal axis 105 and generally includes an outer housing 102, a piston 140 slidably disposed at least partially in housing 102, and a mandrel 160 slidably disposed at least partially in housing 102. In some embodiments, piston 140 comprises a firing head adapter 140 for coupling setting tool 100 with plug-shoot firing head 34. Housing 102 of setting tool 100 has a first end 104, a second end 106 axially spaced from first end 104, a central bore or passage 108 defined by a generally cylindrical inner surface 110 extending between ends 104, 106, and a generally cylindrical outer surface 112 extending between ends 104, 106. In this embodiment, housing 102 comprises a plurality of tubular segments 102A and 1026 coupled together via releasable or threaded connectors 114; however, in other embodiments, housing 102 of setting tool 100 may comprise a single, unitary member. Additionally, an annular seal 116 is positioned radially between tubular segments 102A and 102B of housing 102 to seal the connection formed therebetween from the environment surrounding setting tool 100 (e.g., wellbore 4).

In this embodiment, housing 102 includes at least one shear pin 118 that extends radially into central passage 108 from inner surface 110 and is frangibly connected to piston 140. As will be discussed further herein, shear pin 118 restricts relative axial movement between piston 140 and housing 102 prior to the actuation of setting tool 100. Additionally, in this embodiment, the inner surface 110 of housing 102 includes a radially inwards extending shoulder or flange 120 located proximal second end 106. The inner surface 112 of flange 120 includes a pair of axially spaced annular seals 122 that sealingly engage mandrel 160 of setting tool 100. Housing 102 also includes at least one vent port 124 axially located between flange 120 and second end 106, where vent port 124 extends radially between inner surface 110 and outer surface 112 of housing 102. In this configuration, vent port 124 provides fluid communication between at least a portion of central passage 108 of housing 102 and the environment surrounding setting tool 100. In this embodiment, the outer surface 112 of housing 102 further includes a releasable or threaded connector 126 at second end 106 for threadably connecting with a corresponding connector of downhole plug 36 (not shown in FIGS. 2-5).

Piston 140 of setting tool 100 has a first end 142, a second end 144 axially spaced from first end 142, a central bore or passage 146 defined by a generally cylindrical inner surface 148 extending between ends 142, 144, and a generally cylindrical outer surface 150 extending between ends 142, 144. In this embodiment, piston 140 comprises a plurality of tubular segments 140A, 140B coupled together via a releasable or threaded connector 152; however, in other embodiments, piston 140 of setting tool 100 may comprise a single, unitary member. Additionally, a pair of annular seals 154 are positioned radially between tubular segments 140A, 140B of piston 140 to seal the connection formed therebetween from central passage 108 of housing 102 and the environment surrounding setting tool 100 (e.g., wellbore 4). Further, an annular seal 155 is positioned adjacent to connector 152 to sealingly engage the inner surface 110 of housing 102.

In this embodiment, the inner surface 148 of piston 140 includes a releasable or threaded connector 156 located at second end 144 for releasably connecting to a corresponding connector of mandrel 160. Although in this embodiment piston 140 and mandrel 160 comprise distinct, releasably connectable members, in other embodiments, piston 140 and mandrel 160 may comprise a single, unitary member. In this embodiment, piston 140 includes one or more circumferentially spaced ports 158 that extend at an angle relative to central axis 105 of setting tool 100. Particularly, each port 158 includes a first end formed at the inner surface 148 and a second end formed at the second end 144 of piston 140. In this configuration, the second end of each port 158 is disposed circumferentially about and radially spaced from central passage 146. Further, piston 140 includes a pair of annular seals 159 disposed on outer surface 150 and located proximal second end 144. Seals 159 of piston 140 sealingly engage the inner surface 110 of housing 102.

Mandrel 160 of setting tool 100 has a first end 162, a second end 164 axially spaced from first end 162, and a generally cylindrical outer surface 166 extending between ends 162, 164. In this embodiment, the outer surface 166 of mandrel 160 includes a first releasable or threaded connector 168 located at first end 162 and a second releasable or threaded connector 170 located at second end 164. First releasable connector 168 of mandrel 160 threadably connects to the releasable connector 156 of piston 140 to thereby releasably connect piston 140 with mandrel 160. Second releasable connector 170 of mandrel 160 releasably or threadably connects with a corresponding connector of a mandrel of downhole plug 36 (not shown in FIGS. 2-5). In some embodiments, the outer surface 166 of mandrel 160 may includes a radially outwards extending annular shoulder located proximal releasable connector 170. The outwards extending annular shoulder may have a larger diameter than an inner diameter of the flange 120 of housing 102, thereby preventing the outwards extending annular shoulder from passing through flange 120.

Setting tool 100 includes a combustible assembly or power cartridge 180 that is received in the passage 146 of piston 140. As will be described further herein, at least a portion of power cartridge 180 is configured to ignite or combust to thereby set or actuate setting tool 100. In some embodiments, power cartridge 180 is ballistically connected to an ignitor (not shown) that is in signal communication with wireline 22. In some embodiments, the ignitor may be disposed in plug-shoot firing head 34; however, in other embodiments, it may be disposed in setting tool 100. In this manner, a firing signal may be communicated to the ignitor disposed in setting tool 100 from the surface of wellbore 4 via wireline 22 to ignite power cartridge 180.

Power cartridge 180 of setting tool 100 has a central or longitudinal axis disposed coaxial with central axis 105, a first or upper end 180A, a second or lower end 1806 opposite upper end 180A, and generally includes a tubular outer housing 182 and ignitable or combustible material 198 housed therein. Housing 182 of power cartridge 180 includes a central chamber or passage 184, a first or open end 186 located at upper end 180A of power cartridge 180, a second or enclosed end comprising a cap 188 located at the lower end 180B of power cartridge 180, and an outer surface 190 extending between the open end 186 and cap 188. Cap 188 of housing 182 is positioned directly adjacent or contacts the first end 162 of mandrel 160. In this embodiment, cap 188 is permanently coupled (e.g., welded, formed, molded, etc.) with the tubular portion of housing 182; however, in other embodiments, cap 188 may be releasably coupled with the tubular portion of housing 182. In this embodiment, housing 182 of power cartridge comprises a metallic material (e.g., steel, aluminum, etc.); however, in other embodiments, housing 182 may comprise various materials, such as cardboard, plastic, etc. In this embodiment, combustible material 198 is received in the chamber 184 of housing 182 and extends substantially between open end 186 and cap 188. In this embodiment, combustible material 198 comprises a pyrotechnic compound; however, in other embodiments, combustible material 198 may comprise other ignitable, flammable, and/or combustible materials.

Figure 3:
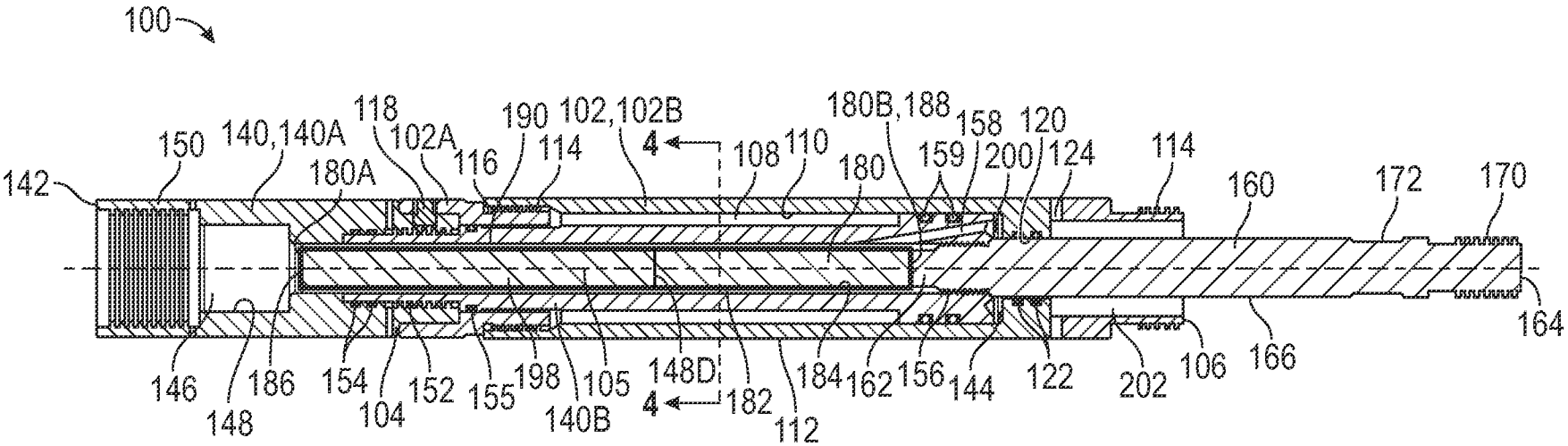
FIG. 3 is a cross-sectional view along lines 3-3 of FIG. 2 of the setting tool of FIG. 2.
Figure 4:
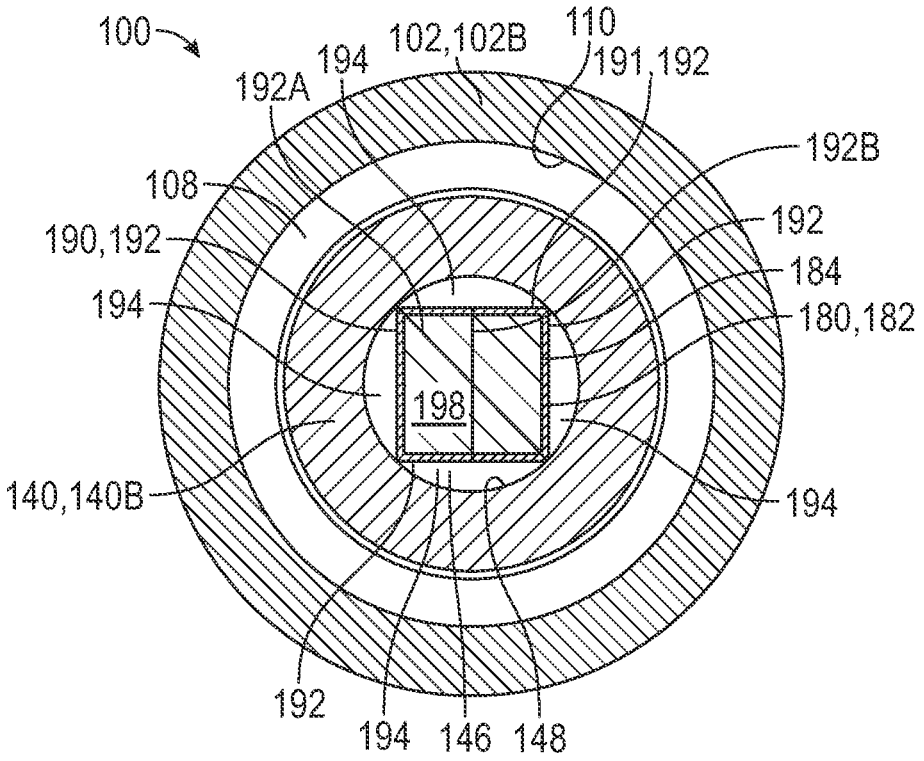
FIG. 4 is a cross-sectional view along lines 4-4 of FIG. 3 of the setting tool of FIG. 2.
Figure 5:
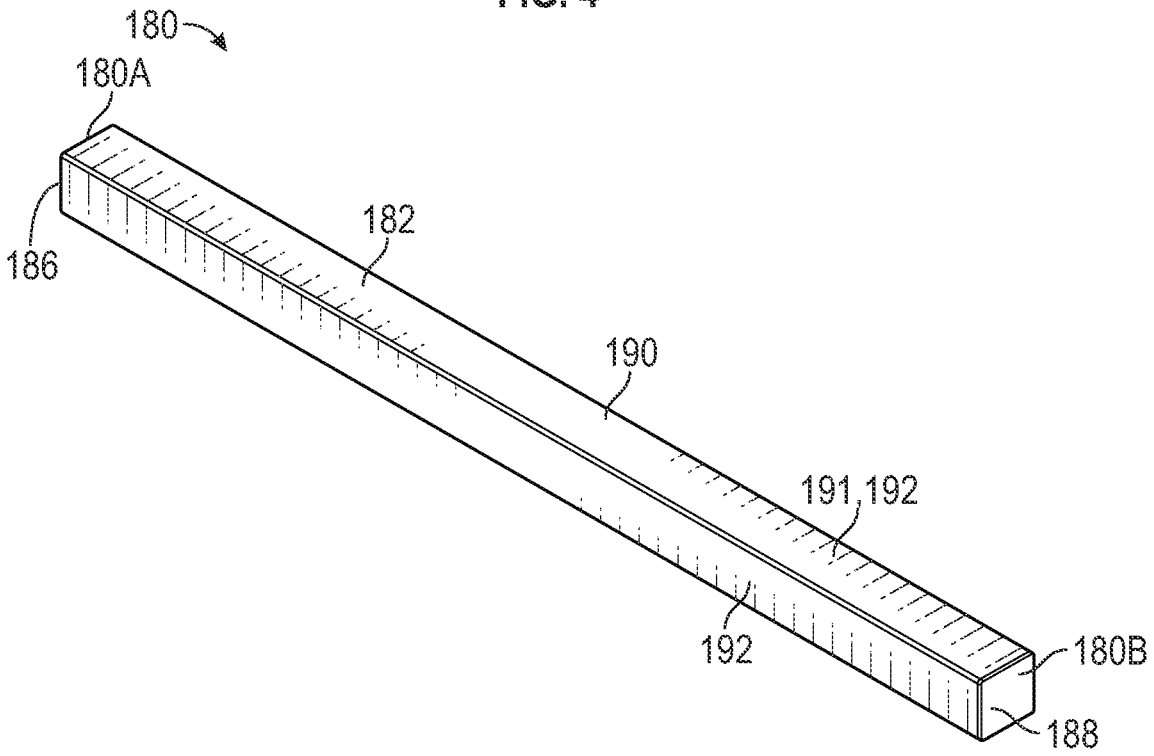
FIG. 5 is a perspective view of an embodiment of a power cartridge of the setting tool of FIG. 2 in accordance with principles disclosed herein.

As shown particularly in FIGS. 4 and 5, in this embodiment, housing 182 of power cartridge 180 has a rectangular cross-sectional profile 191 with the outer surface 190 of housing 182 including a plurality of axially aligned and circumferentially spaced planar or uncurved surfaces 192 extending between open end 186 and cap 188. Rectangular cross-sectional profile 191 formed by planar surfaces 192 of housing 182 has a maximum width 192A and a minimum width 192B. As will be discussed further herein, the maximum width 192A of the rectangular cross-sectional profile 191 is similar or substantially equal to an inner diameter 148D (shown in FIG. 3) of the inner surface 148 of piston 140 while minimum width 192B of the rectangular cross-sectional profile 191 is less than the inner diameter 148D of inner surface 148.

As described above, setting tool 100 is pumped downhole though wellbore 4 along with the other components of tool string 20. As tool string 20 is pumped through wellbore 4, the position of tool string 20 in wellbore 4 is monitored at the surface via signals generated from CCL 26 and transmitted to the surface using wireline 22. Once tool string 20 is disposed in a desired location in wellbore 4, setting tool 100 may be fired or actuated from the run-in position shown in FIG. 2 to the full-stroke position (not shown) to thereby set the downhole plug 36 of tool string 20, and one or more of perforating guns 30 may subsequently be fired to perforate casing 12 at the desired location.

Particularly, when setting tool 100 is run through wellbore 4 along with tool string 20, housing 102 is connected to an outer housing (not shown) of downhole plug 36 via releasable connector 126 and mandrel 160 of setting tool 100 is connected to a mandrel (not shown) of downhole plug 36 via releasable connector 170. In this arrangement, relative axial movement between mandrel 160 and housing 102 of setting tool 100 may provide relative axial movement between the mandrel and outer housing of downhole plug 36 to thereby set downhole plug 36 such that downhole plug 36 seals against an inner surface of casing string 12. Once tool string 20 is disposed in a predetermined or desired position in wellbore 4, setting tool 100 may be set or actuated by igniting or combusting power cartridge 180. In some embodiments, power cartridge 180 is ballistically connected to an ignitor (not shown) that is in signal communication with wireline 22. In some embodiments, the ignitor may be disposed in plug-shoot firing head 34; however, in other embodiments, it may be disposed in setting tool 100. In this manner, a firing signal may be communicated to the ignitor disposed in setting tool 100 from the surface of wellbore 4 via wireline 22 to ignite power cartridge 180.

Fluid pressure begins to build in the central passage 146 of piston 140 following the ignition of the combustible material 198 housed within housing 182 of power cartridge 180, the fluid pressure in passage 146 being communicated to an annular pressure chamber 200 disposed about mandrel 160 and extending axially between seals 159 of piston 140 and seals 122 of the flange 120 of housing 102. As shown particularly in FIG. 4, a plurality of arcuate gaps or openings 194 are formed between planar surfaces 192 of the housing 182 of power cartridge 180 and the inner surface 148 of piston 140. Thus, fluid pressure formed in the chamber 184 of housing 182 created by the ignition of the combustible material 190 of power charge 180 is permitted to flow out into passage 146 via open end 186, and through passage 146 into pressure chamber 200 via arcuate gaps 194 and ports 158 of piston 140.

In this manner, arcuate gaps 194 reduce the restriction to the communication of fluid flow and/or pressure between open end 186 of the housing 182 of power cartridge 180 and pressure chamber 200. The reduction in the restriction of flow and/or pressure communication along a flowpath extending through passage 146 of piston 140 provided by arcuate gaps 194 prevents excessive fluid pressure from building in the chamber 184 of housing 182 and/or passage 146 of piston 140, thereby reducing the likelihood of either housing 182 and/or piston 140 failing or otherwise being damaged during the actuation of setting tool 100. Although in this embodiment arcuate gaps 194 are formed via planar surfaces 192 of the housing 182 of power cartridge 180, in other embodiments, one or more radial openings or gaps may be formed between housing 182 and piston 140 via other features located on the outer surface 190 of housing 182, such as axially extending grooves formed in the outer surface 190 of housing 182, or other features permitting fluid flow between housing 182 and piston 140.

Fluid pressure building in pressure chamber 200 acts against the second end 144 of piston 140, applying an axially directed upward force (e.g., in the direction of plug-shoot firing head 34) against piston 140. The axially directed force applied against piston 140 from fluid pressure in pressure chamber 200 shears the shear pin 118, allowing piston 140 and mandrel 160 to travel or stroke upwards in the direction of plug-shoot firing head 34. As mandrel 160 strokes upwards in concert with piston 140, mandrel 160 actuates or pulls the mandrel of downhole plug 36, thereby displacing the mandrel of downhole plug 36 relative to the outer housing of plug 36. Fluid pressure in pressure chamber 200 continues to force piston 140 and mandrel 160 axially upwards, causing an annular groove 172 formed in the outer surface 166 of mandrel 160 to pass and enter into axial alignment with flange 120 of the housing 102 of setting tool 100. An annular passage formed between the inner surface of flange 120 and annular groove 172 of the outer surface 166 of mandrel 160 permits fluid pressure in pressure chamber 200 to vent to an annular vent chamber 202 disposed about mandrel 160 and extending axially between seals 122 of flange 120 and the second end 106 of housing 102. Additionally, fluid vented to vent chamber 202 from pressure chamber 200 is vented from setting tool 100 to wellbore 4 via the vent port 124 formed in housing 102. In other embodiments, housing 102 may not include vent port 124 and pressure within pressure chamber 200 may be vented through other means.

Figure 6:
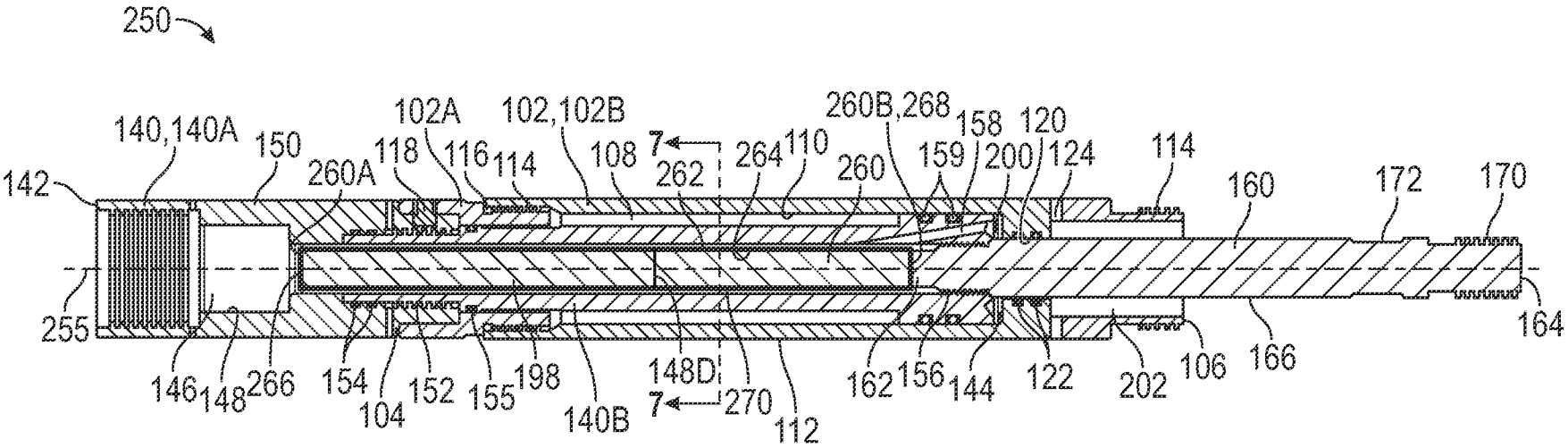
FIG. 6 is a side cross-sectional view of another embodiment of the setting tool of FIG. 1 in accordance with principles disclosed herein.
Figure 7:
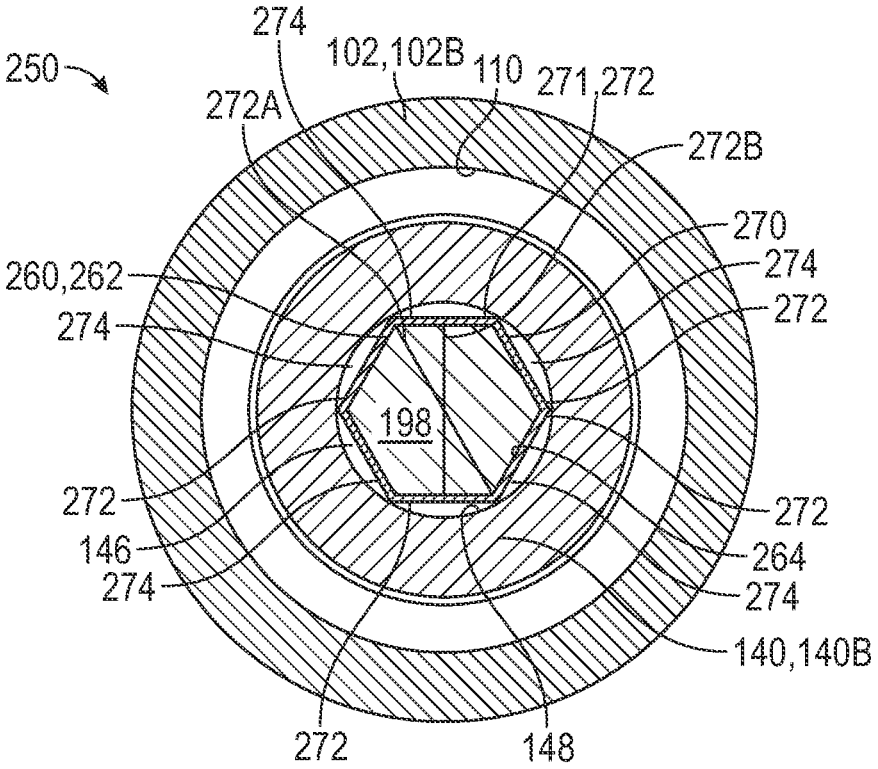
FIG. 7 is a cross-sectional view along lines 7-7 of FIG. 6 of the setting tool of FIG. 6.
Figure 8:
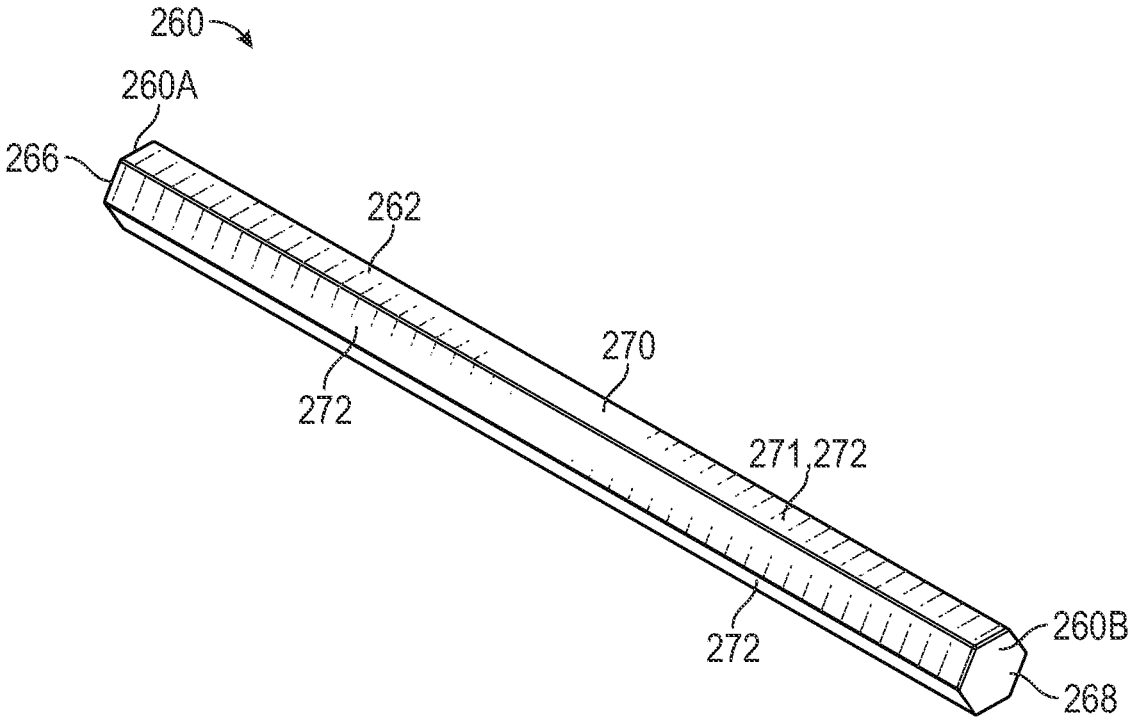
FIG. 8 is a perspective view of an embodiment of a power cartridge of the setting tool of FIG. 6 in accordance with principles disclosed herein.

Referring to FIGS. 1 and 6-8, another embodiment of a setting tool 250 of the tool string 20 of FIG. 1 is shown in FIGS. 6-8. Setting tool 250 includes features in common with the setting tool 100 shown in FIGS. 2-5, and shared features are labeled similarly. In the embodiment of FIGS. 6-8, setting tool 250 has a central or longitudinal axis 255 and generally includes outer housing 102, piston 140, mandrel 160, and a power cartridge 260 received in the passage 146 of piston 140. In this embodiment, power cartridge 260 has a central or longitudinal axis disposed coaxial with central axis 255 of setting tool 250, a first or upper end 260A, a second or lower end 260B opposite upper end 260A, and generally includes a tubular outer housing 262 and combustible material 198 housed therein. Housing 262 of power cartridge 260 includes a central chamber or passage 264, a first or open end 266 located at upper end 260A, a second or enclosed end comprising a cap 268 located at lower end 260B, and an outer surface 270 extending between the open end 266 and cap 268.

As shown particularly in FIGS. 7 and 8, unlike power cartridge 180 shown in FIGS. 3-5 which includes rectangular cross-sectional profile 191, housing 262 of power cartridge 260 has a hexagonal cross-sectional profile 271 with the outer surface 270 of housing 262 including a plurality of axially aligned and circumferentially spaced planar or uncurved surfaces 272 extending between open end 266 and cap 268. Hexagonal cross-sectional profile 271 formed by planar surfaces 272 of housing 262 has a maximum width 272A and a minimum width 272B. In this embodiment, the difference between maximum width 272A and minimum width 272B of hexagonal cross-sectional profile 271 may be less than the difference between maximum width 192A and minimum width 192B of the rectangular cross-sectional profile 191 of housing 182 shown in FIGS. 3-5. However, in this embodiment, a greater number of arcuate gaps or openings 274 are formed between planar surfaces 272 of the housing 262 of power cartridge 260 and the inner surface 148 of piston 140 than the number of arcuate gaps 194 formed between the planar surfaces 192 (shown in FIG. 4) of the housing 182 of power cartridge 180 and the inner surface 148 of piston 140.

In this manner, sufficient cross-sectional area may be provided between the planar surfaces 272 of housing 262 and the inner surface 148 of piston 140 to permit the necessary communication of pressure and/or fluid flow through passage of piston 140 during the actuation of setting tool 250 to prevent damage occurring (e.g., due to over pressurization) to housing 262 and/or piston 140, as well as other components of setting tool 250. Further, although in this embodiment housing 262 of power cartridge 260 includes a hexagonal cross-sectional profile 271, in other embodiments, the outer surface 270 of housing 262 may comprise varying cross-sectional profiles configured to provide gaps or spaces (e.g., annular, arcuate, etc.) between outer surface 270 and the inner surface 148 of piston 140.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tool string disposable in a wellbore, comprising:

a plug configured to seal against an inner surface of a tubular string disposed in the wellbore; and a setting tool coupled to the plug, comprising:

a piston slidably disposed in a housing of the setting tool and comprising a central passage; and a combustible assembly disposed in the passage of the piston, wherein the combustible assembly comprises a housing and combustible material disposed in the housing, and wherein both the housing of the combustible assembly and the combustible material are disposed in the passage of the piston;

wherein the housing of the combustible assembly contacts an inner surface of the piston whereby an arcuate gap is formed between the housing of the combustible assembly and the inner surface of the piston;

wherein, in response to a pressurization of the central passage of the piston of the setting tool, the setting tool is configured to actuate the plug to seal against the inner surface of the tubular string.

2. The tool string of claim 1, wherein the combustible assembly housing comprises a plurality of the planar surfaces and wherein the planar surfaces are circumferentially spaced about the housing.

3. The tool string of claim 1, wherein:

the housing of the setting tool is coupled to a housing of the plug; and the setting comprises a mandrel coupled to the piston, the mandrel of the setting tool being coupled to a mandrel of the plug, and wherein displacement of the mandrel of the setting tool results in displacement of the mandrel of the plug.

4. The tool string of claim 1, further comprising:

a plug-shoot firing head coupled to the setting tool; and a wireline extending from the tool string to an upper end of the wellbore;

wherein the plug-shoot firing head comprises an ignitor ballistically coupled to the combustible assembly and is configured to ignite the combustible material of the combustible assembly in response to receiving a signal transmitted by the wireline.

5. The tool string of claim 1, wherein the combustible assembly comprises a power cartridge.

6. The tool string of claim 1, wherein the combustible assembly housing comprises a rectangular cross-section having a maximum width and a minimum width that is less than the maximum width.

7. The tool string of claim 1, wherein the combustible assembly housing comprises a hexagonal cross-section having a maximum width and a minimum width that is less than the maximum width.

8. The tool string of claim 1, wherein the setting tool comprises:

a first chamber and a second chamber are formed in the setting tool housing;

wherein fluid communication between the first chamber and the second chamber is restricted when the piston is in a first position, and wherein fluid communication is permitted between the first chamber and the second chamber when the piston is in a second position.

9. The tool string of claim 8, wherein the setting tool comprises:

a mandrel slidably disposed in the setting tool housing and coupled to the piston; and an annular seal positioned between the mandrel and the setting tool housing, wherein the annular seal isolates the first chamber from the second chamber in the setting tool housing.

10. The tool string of claim 8, wherein the arcuate gap comprises a flowpath for providing fluid communication between a chamber formed in the combustible assembly housing and the first chamber.

11. The tool string of claim 10, wherein the arcuate gap is formed between a planar surface of the combustible assembly housing and the inner surface of the setting tool housing.

12. A setting tool for actuating a plug in a wellbore, comprising:

a housing comprising a central passage, wherein a first chamber and a second chamber are formed in the setting tool housing;

a piston slidably disposed in the setting tool housing and comprising a central passage; and a combustible assembly disposed in the passage of the piston, wherein the combustible assembly comprises a housing and combustible material disposed in the combustible assembly housing;

wherein fluid communication between the first chamber and the second chamber is restricted when the piston is in a first position, and wherein fluid communication is permitted between the first chamber and the second chamber when the piston is in a second position;

wherein, in response to a pressurization of the central passage of the piston, the setting tool is configured to displace the piston between the first position and the second position;

wherein an opening is formed between an outer surface of the combustible assembly housing and an inner surface of the piston, and wherein the opening comprises a flowpath for providing fluid communication between a chamber formed in the combustible assembly housing and the first chamber.

13. The setting tool of claim 12, further comprising:

a mandrel slidably disposed in the setting tool housing and coupled to the piston; and an annular seal positioned between the mandrel and the setting tool housing, wherein the annular seal isolates the first chamber from the second chamber in the setting tool housing.

14. The setting tool of claim 12, wherein the opening comprises an arcuate opening formed between a planar surface of the combustible assembly housing and the inner surface of the setting tool housing.

15. The setting tool of claim 12, wherein an outer surface of the combustible assembly housing comprises a plurality of circumferentially spaced planar surfaces.

16. The setting tool of claim 12, wherein the combustible assembly housing comprises a rectangular cross-section having a maximum width and a minimum width that is less than the maximum width.

17. The setting tool of claim 12, wherein the combustible assembly housing comprises a hexagonal cross-section having a maximum width and a minimum width that is less than the maximum width.

18. The setting tool of claim 12, wherein the combustible assembly comprises a power cartridge.

* * * * *